US005183218A

United States Patent [19]

Gavagna

[11] Patent Number: 5,183,218

[45] Date of Patent: Feb. 2, 1993

[54] DEVICE FOR THE OPERATION OF HOSES CONTAINING A LIQUID UNDER VERY HIGH PRESSURE

[75] Inventor: Libero Gavagna, Poggio Renatico, Italy

[73] Assignee: MIGEN S.r.l.

[21] Appl. No.: 654,543

[22] Filed: Feb. 13, 1991

[30] Foreign Application Priority Data

Mar. 8, 1990 [IT] Italy ..... 19608 A/90

[51] Int. Cl.[5] ..... B65H 23/00; B65H 20/00; B65H 18/00

[52] U.S. Cl. ..... 242/54.00 R; 242/86; 242/86.1; 242/117; 254/333; 137/355.12

[58] Field of Search ..... 242/54 R, 86, 86.1, 242/86.2, 117, 158.3; 254/333; 137/355.12, 355.16, 355.19, 355.2

[56] References Cited

U.S. PATENT DOCUMENTS

| | | | |
|---|---|---|---|
| 2,533,592 | 12/1950 | Landon | 254/333 |
| 2,599,423 | 6/1952 | Ziegler | 242/86 |
| 2,625,373 | 1/1953 | Hunt | 242/117 |
| 2,976,017 | 3/1961 | LeBus, Sr. | 254/333 |
| 3,309,066 | 3/1967 | Carlson | 242/54 R |
| 3,843,094 | 10/1974 | Watts | 254/333 |
| 4,026,525 | 5/1977 | Declercq | 254/333 |
| 4,066,093 | 1/1978 | Egerstrom | 242/117 |
| 4,103,841 | 8/1978 | Flynn et al. | 242/86.2 |
| 4,655,399 | 4/1987 | Harvey | 242/86.2 |
| 5,050,813 | 9/1991 | Ishikawa et al. | 242/86.1 |

FOREIGN PATENT DOCUMENTS

| | | | |
|---|---|---|---|
| 2642462 | 4/1977 | Fed. Rep. of Germany . | |
| 3601208 | 5/1987 | Fed. Rep. of Germany | 242/54 R |
| 2195229 | 3/1974 | France . | |
| 452996 | 8/1986 | U.S.S.R. | 242/54 R |

*Primary Examiner*—Daniel P. Stodola
*Assistant Examiner*—John Q. Nguyen
*Attorney, Agent, or Firm*—Oliff & Berridge

[57] ABSTRACT

A device for operating flexible elements includes a rotating drum around which flexible elements are wound to be advanced, a container of the drum equipped with a series of rubber rollers which hold the flexible elements in adherence with the outer surface of the drum and which has a longitudinal slot which permits passage of the flexible elements from the inside to the outside of the container, and a moving guide for the flexible elements positioned across the drum and which moves with reciprocating movement and facilitates winding or unwinding of the flexible elements on or from the drum.

8 Claims, 1 Drawing Sheet

DEVICE FOR THE OPERATION OF HOSES CONTAINING A LIQUID UNDER VERY HIGH PRESSURE

FIELD OF THE INVENTION

The present invention relates to a device for operating flexible elements. The device is particularly useful for automatically advancing in a controlled manner flexible elements which must be inserted in very long longitudinal cavities such as for nozzles for cleaning the inner surfaces of a pipe by water or other pressurized liquids, painting the internal surface of piping, insertion of cables in sheaths designed to cover them, insertion of radiography devices inside piping, etc.

BACKGROUND OF THE INVENTION

It is known that one of the main problems encountered in advancing a flexible element inside a very long cavity consists of the poor ability of the flexible element to absorb resistance to advancement without distortion in the part not yet inserted in the cavity. Said undesirable distortion of the flexible element, in addition to being a factor of rapid wear of said element, makes the advancing motion of the flexible element irregular with resulting reduction of the quality of the work performed and increase of costs due to a greater number of passes to obtain the same results than there would be if motion were controlled in a uniform manner. Finally where the flexible element is a hose containing a liquid under very high pressure, e.g. up to 3,000 bar, as in the case of cleaning the internal surfaces of the tubes of a tube nest, irregular advancement of the hose can be very dangerous for the operator who has to handle said hose. The operations which require the use of a hose to be inserted in a very long longitudinal cavity are normally performed in a nonautomatic manner and manually. The operator inserts the end of the hose into the longitudinal cavity in which said hose must run and pushes the hose until it reaches the other end of the cavity. If the flexible element must remain in the same place, (e.g. if it is a cable), the operation is terminated. If the hose was used for inspection or cleaning the motion is reversed and the hose is drawn back until it goes out of the end of the cavity in which it had been inserted.

In the case of cleaning or internal treatment of tube bundles with pressurized liquids, the insertion and withdrawal of the hose are performed tube by tube with a single hose and interrupting the flow of liquid which passes through the hose before withdrawing it from each tube and turning on flow again after insertion in the next tube.

It is just these insertion and withdrawal operations which represent the greatest danger for safety of the operator in case he does not turn off in a timely manner the liquid in the hose before its withdrawal from each tube. The liquid jet under very high pressure which comes out of the operating end of the hose, no longer contained by the walls of the tube being treated, can very seriously injure the operator or persons in the vicinity of the tube nest being treated.

It is thus clear why tube nests are not cleaned directly on the plant where they are installed but are disassembled and placed on supports which make their treatment easier and safer. A second defect of these manual operations consists of the fact that the operator tends to stop the flow of liquid inside the hose well before withdrawing it from the tube being worked on to increase his own safety and this circumstance reduces the effectiveness of the cleaning because a considerable part of the tube undergoes a single cleaning pass and not both passes of the advancing and withdrawal phases.

SUMMARY OF THE INVENTION

The Assignee has long experience in the field of hydrokinetic systems for cleaning and maintenance of chemical and petroleum plants and has conceived and perfected a device which resolves in a highly satisfactory manner the problems of operation safety and work quality described above.

In accordance with a basic characteristic the device of the invention consists of the following basic parts:

a) a rotating drum around which are wound the flexible elements to be handled, b) a container of said drum equipped with a series of rollers which hold said flexible elements in adherence with the outer surface of the drum and said container having a transverse aperture which permits passage of the flexible elements from the inside of the container to the outside thereof, c) a moving guide for said flexible elements positioned transversely to the drum and which moves with reciprocating motion and aids winding or unwinding of the flexible element onto or from the drum, d) one or more flexible elements of a length such as to meet the necessity for which the device is designed to be employed, and e) a motor which drives through appropriate motion reducers and transmitters rotation of the drum and movement of the moving guide in a mutually coordinated manner.

In accordance with a basic characteristic of the invention the relationship of the drum diameter to the diameter of the flexible element is such as to permit winding and unwinding of the flexible element within the allowed distortion limits of the hose.

The width of the drum is readily calculated on the basis of the diameter and length of the flexible element which is to be wound thereon in such a manner that the coils of the flexible elements wound never overlie each other.

Typically a drum with a diameter of 80 cm and width of 45 cm allows winding of 50 m of a hose having a diameter between 1.4 cm and 1.6 cm. It is clear that several flexible elements can be wound around the drum parallel to each other in such a manner as to cause them all to move simultaneously and obtain a multiplication of the services of the device.

Another important characteristic of the device of the invention consists of the ratio of the diameter of the rollers to that of the drum, which is typically between 1:30 and 1:10.

The rollers have two central axial pivots which permit free rotation thereof while holding them at the same time in position around the drum and interacting with the two circular guides made in the side walls of the container.

In a typical form of embodiment of the device in accordance with the invention said rollers rotate by friction with the outer edges of said drum. The outer edges of the drum and the rollers are covered with rubber or other elastomeric substance to facilitate motion transmission. In the preferred form of embodiment of the invention the coating of the outer edges of the drum is assured by the insertion of two belts of selected material having the same diameter as the drum and a thickness such as to ensure friction with the rollers. This form of embodiment is particularly preferred because it facilitates maintenance of the device and permits easy replacement of the belts when they are worn.

In accordance with one preferred form of embodiment of the invention the device comprises a control system which regulates the speed of feed of the flexible elements and the distance to be travelled by the heads of said elements before reversal of the unwinding motion and starting of the rewinding of the hoses on the drum.

On the leading ends of the flexible elements of the device are appropriately fixed tools to be used for the work which the device is to perform, i.e. radioactive elements (in the case of radiography of tubes), nozzles of various kinds for cleaning or painting, etc. Considering the extreme adaptability and great performance of the device of the invention every technician having problems of using flexible elements will have no difficulty in adapting the device of the invention to his own particular problem.

If the flexible elements of the device in accordance with the invention are hoses for cleaning or painting they are connected to the liquid feed pump by appropriate unions located in the central part of the drum.

The device of the invention is connected to the object to be treated by a tube of appropriate length and a diameter slightly greater than that of the flexible element of the device. The flexible element of the device is inserted in said tube at the outlet of the device and is run therein up to the opening of the tube to be treated. The connecting tube is fixed to the device of the invention by a flange or other union while connection to the object to be treated is made by a rigid terminal part. Said rigid part has typically a length between 10 cm and 100 cm and is inserted a few centimeters in the longitudinal cavity to be treated and acts at the same time as a handgrip for the operator in such a manner as to facilitate movement of the flexible element from one cavity to the next one to be treated at the end of each operation. In the preferred form of embodiment of the invention said handgrip comprises also the control pushbuttons for the operator.

In the forms of embodiment of the invention which have several flexible elements parallel to each other and which move simultaneously the connecting tube can be either one only for all the flexible elements operated or one for each of said elements.

DETAILED DESCRIPTION OF THE PREFERRED EMBODIMENT

Figure 1:
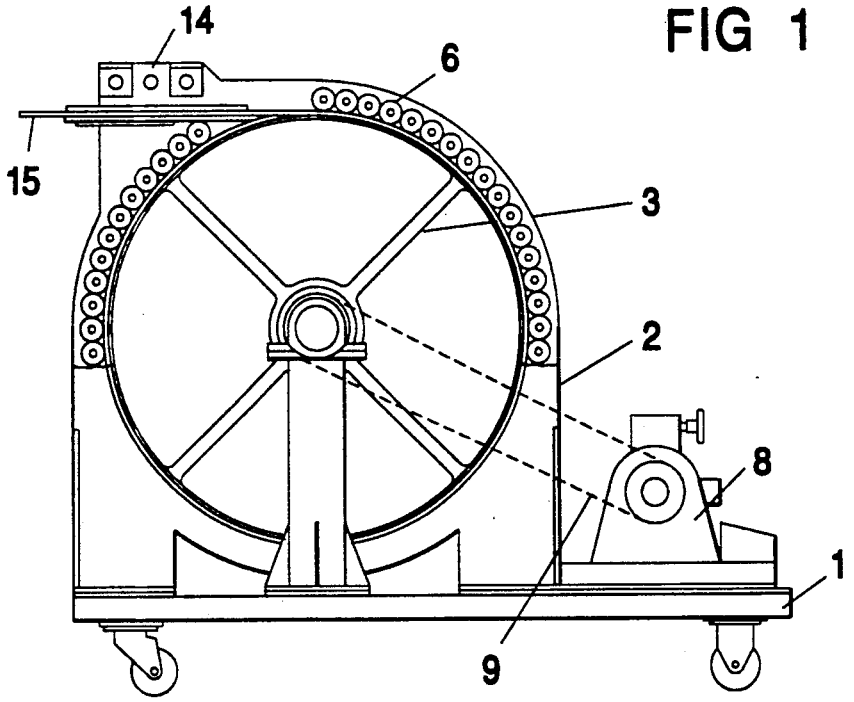
FIG. 1 shows a schematic vertical cross section of the device in accordance with the invention.
Figure 2:
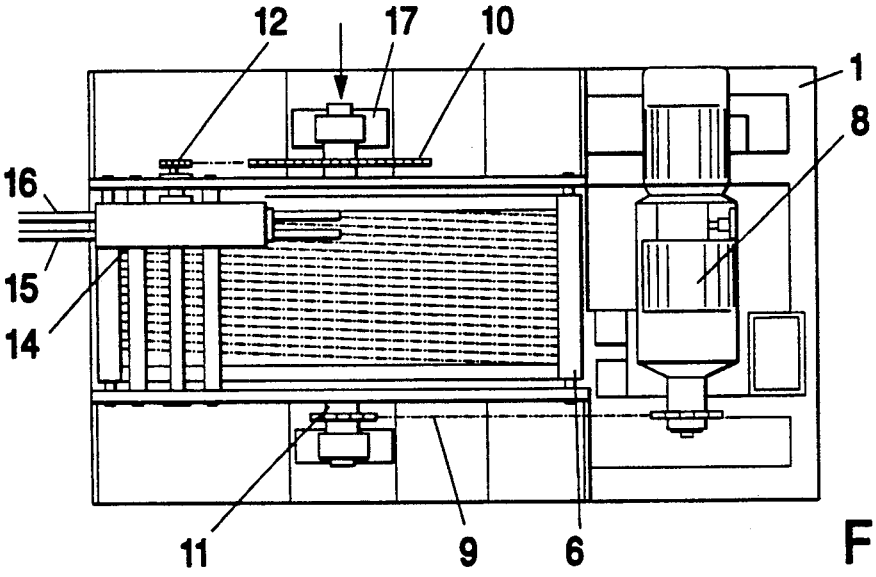
FIG. 2 shows a schematic horizontal cross section of said device.
Figure 3:
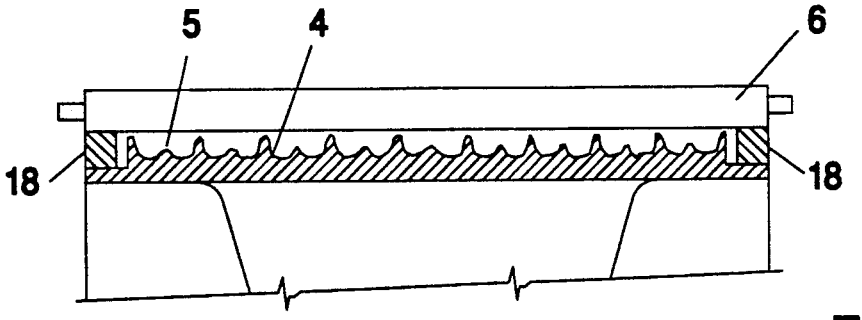
FIG. 3 shows a vertical cross section of a detail of the device rotated 90° from the one shown in FIG. 1.

With particular reference to the annexed drawings there is described below a preferred form of embodiment of the device in accordance with the invention adapted for cleaning the inside of the tubes of a heat exchanger with a tube nest.

On a wheeled cart 1 there is mounted a container 2 which encloses a drum 3 whose external surface 4 is appropriately shaped with a double groove 5 which allows simultaneous winding or unwinding of two hoses 15 and 16 which are held pressed against the drum 3 by a series of rollers 6 arranged around the drum 3.

A ratiomotor 8 mounted on the cart 1 moves the drum 3 through a roller chain 9. A second roller chain 10 unites the shaft 11 of the drum 3 to a worm screw 12 which moves with reciprocating motion a saddle 14 over which pass the two hoses 15 and 16 and to which is fixed a tube (one for both hoses) of appropriate length which permits connection of the device to the tube nest to be cleaned. The shaft 11 of the drum is hollow and communicates with the end of the hoses 15 and 16 wound on the drum. Said hollow shaft 11 has a pressurized seal 17 which permits connection thereof to the feed piping for pressurized cleaning. The rollers 6 have a rubberized surface and are rotated by friction with the two rubber belts 18 inserted on the side edges of the drum 3.

The device illustrated is also equipped with a control panel which permits regulation of the feed speed of the hoses and reversal of movement on the basis of the programme set on the control panel for the length of the tube to be cleaned.

The above device has been used on exchangers with tubes as long as 24 meters by a single operator who could operte the two cleaning hoses simultaneously with much less fatigue than when using a single hose without the device of the invention.

Among the other advantages found in the use of the above device particularly interesting is substitution of the outlet nozzles of the pressurized water placed at the ends of the tubes with other types much more effective for cleaning but which it is not possible to use with only manual operations due to the excessive effort required of the operator for operation.

I claim:

1. A device for the operation of at least one hose containing a liquid under very high pressure, in particular for cleaning internal surfaces of tubes of a tube nest, comprising:

a) at least one hose;

b) a rotating drum around which the at least one hose is wound, forming one coil;

c) a belt inserted on each of at least one outer edge of said drum;

d) a container of said drum equipped with a series of contiguous rollers which are in contact with said belt, said belt causing said rollers to rotate, said belt being an elastomeric substance having a thickness assuring contact with said rollers wherein said rollers hold said at least one hose in adherence with an outer surface of said drum, said container having a transverse aperture which permits passage of said at least one hose between an inside and an outside of said container;

e) a moving guide for said at least one hose positioned transversely to said drum, said moving guide moving with transversely reciprocating motion and aiding in winding and unwinding said hose onto and off of said drum; and f) a motor for driving the drum and for moving the moving guide in a mutually coordinated manner.

2. The device of claim 1, wherein the drum is connected to the motor via a roller chain.

3. The device of claim 1, wherein said moving guide is moved by a worm screw connected through a roller chain to said drum.

4. The device of claim 1, wherein an external surface of said drum is shaped with a plurality of grooves for allowing simultaneous winding or unwinding of more than one said hose, each hose being wound or unwound in a separate groove of said plurality of grooves.

5. The device of claim 4, wherein said drum has a width sufficient to allow winding of the at least one hose so that a coil of one hose does not overlap a coil of another hose.

6. The device of claim 1, wherein said drum has a diameter such that a ratio of the drum diameter to a diameter of said at least one hose permits winding and unwinding of said at least one hose within an allowed distortion limit of said at least one hose.

7. The device of claim 1, wherein a ratio of a diameter of said rollers to a diameter of said drum is between 1:30 and 1:10.

8. The device of claim 1, wherein said drum has a diameter of 80 cm and a width of 45 cm and permits winding of at least a 50 m length of hose having a diameter between 1.4 cm and 1.6 cm.

* * * * *